United States Patent [19]

Graef et al.

[11] 4,015,537

[45] Apr. 5, 1977

[54] INTERIOR RAILWAY TRANSPORTATION SYSTEM

[75] Inventors: Harry T. Graef, Dover; Kenneth R. Hansen, Massillon; Larry A. Morrison, North Canton, all of Ohio

[73] Assignee: Diebold, Incorporated, Canton, Ohio

[22] Filed: June 9, 1975

[21] Appl. No.: 585,025

[52] U.S. Cl. ..... 104/91; 104/94; 104/107; 105/30; 105/153; 186/7; 191/22 R; 238/148

[51] Int. Cl.[2] ..... B61B 3/02; B61B 13/00; B61C 11/00; B61C 13/04

[58] Field of Search ..... 104/89, 91, 94, 95, 104/106, 107, 108, 121, 246, 247, 1 B, 88, 111; 105/29 R, 30, 146, 147, 153, 154, 155, 156; 186/7; 191/2, 22 R, 45 R, 59; 238/127, 134, 135, 143, 148, 284, 382, 113

[56] References Cited

UNITED STATES PATENTS

| | | | |
|---|---|---|---|
| 209,739 | 11/1878 | Welch | 238/148 |
| 479,762 | 7/1892 | Livermore | 186/7 |
| 2,132,187 | 10/1938 | Rand, Jr. | 191/22 R X |
| 2,913,997 | 11/1959 | Wolf | 105/30 X |
| 3,356,276 | 12/1967 | Robinson, Jr. et al. | 238/148 X |
| 3,540,153 | 11/1970 | Aoki | 105/29 R X |
| 3,842,744 | 10/1974 | Vis | 104/88 |
| 3,922,970 | 12/1975 | Glastra | 104/91 |
| 3,935,822 | 2/1976 | Kaufmann | 105/153 X |

*Primary Examiner*—Robert J. Spar
*Assistant Examiner*—Howard Beltran
*Attorney, Agent, or Firm*—Frease & Bishop

[57] ABSTRACT

A self-propelled car and load-conveying container on the car travel along a track system having horizontal and vertical track runs with bends or curves between such runs, and having inside and outside corner bends or curves between horizontal track runs . The track system also has switches to connect the system between various stations at various locations on the same or different building floors. The track is generally channel-shaped with spaced rail heads at the extremities of the channel legs. The channel web always has vertical orientation for the horizontal and vertical track runs and bends. The track is formed in sections, and the rail heads have replaceable wear strips. The track sections and wear strips have staggered, non-registering joints. Car travel control strips are mounted at desired locations on the track. Spring-pressed, rounded-groove guide wheels support the car on the track. Car movement control brushes are mounted on the car engageable with the control strips. Motor-driven friction roll means and an energy cell for the motor are mounted on the car and move the car along the track. The container for the load to be moved between stations is pivotally mounted on the car and thus allows the container to remain level, regardless of car location in the track system. A cooperative interlock connects the container door and car drive to prevent car movement if the door is not closed and locked. The car has an obstruction detector which stops car movement when an obstruction is encountered.

27 Claims, 33 Drawing Figures

FIG. 22
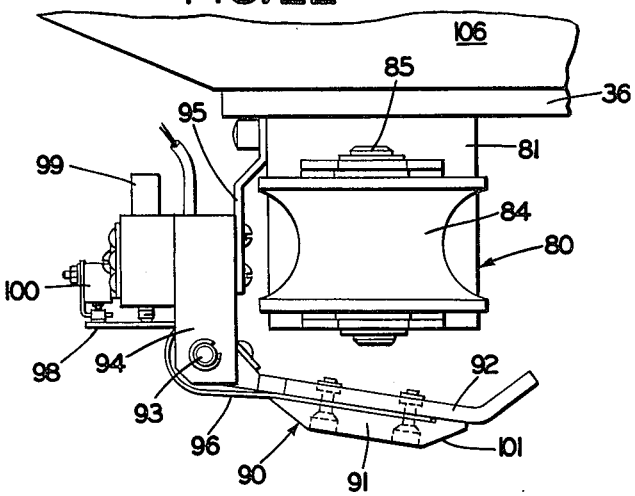
FIG. 28
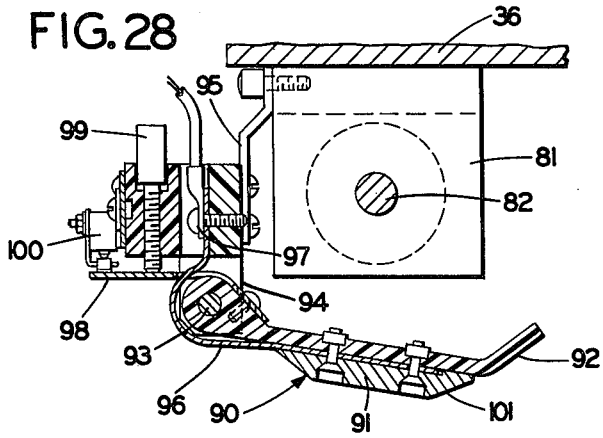
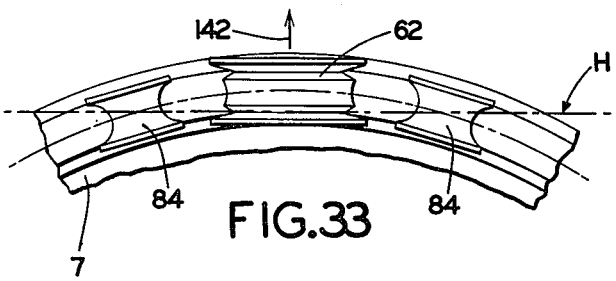
FIG. 33
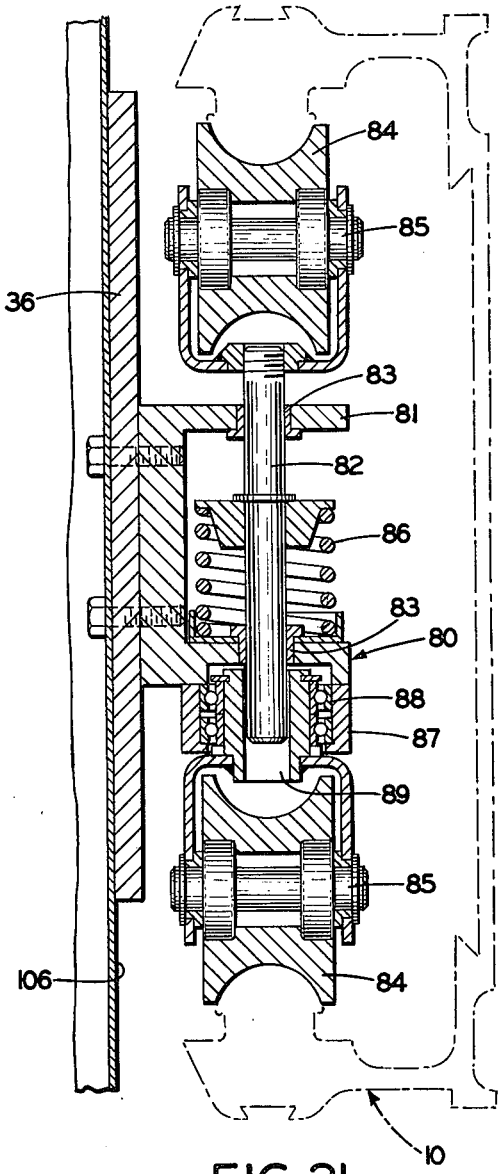
FIG. 21
FIG. 32
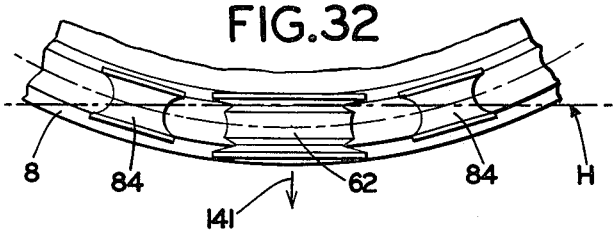
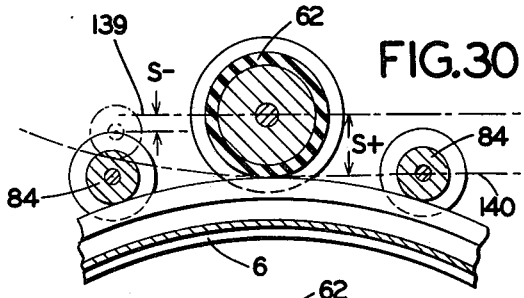
FIG. 30
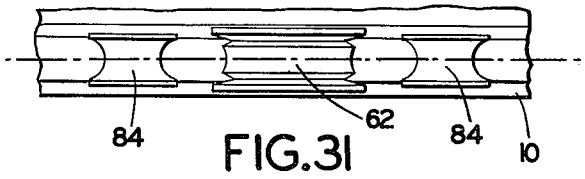
FIG. 31
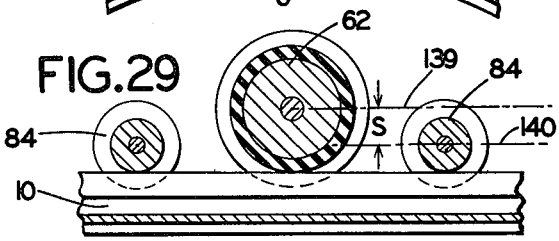
FIG. 29

INTERIOR RAILWAY TRANSPORTATION SYSTEM

BACKGROUND OF THE INVENTION

1. Field of the Invention

The invention relates to an automated materials transportation system installed in a building having a track connecting many stations and having a plurality of cars moving in the track system from station to station and capable of horizontal and vertical travel. For example, a hospital, bank, industrial or office building may have automated movement of cars between stations at various locations on any floor and on different building floors.

Further, and more specifically, the invention relates to track, car and car-supported container construction for automated self-propelled economical and efficient movement of materials or loads in a conveyor or distribution system which involves horizontal and vertical travel of container-carrying cars on a track system that services multiple stations to move loads in the containers automatically between selected stations.

2. Description of the Prior Art

Prior self-propelled car transportation sytems have been used, such as shown in Glastra application Ser. No. 244,265, filed Apr. 14, 1972, now U.S. Pat. No. 3,922,970 to accomplish the general objectives of the described apparatus. However, many difficulties have been encountered and drawbacks discovered concerning the construction, assembly, operation and use of the tracks and car structures shown in said application Ser. No. 244,265.

Thus, the tubular track rails with interconnecting, spaced clips of such prior track structures are difficult to mount and support with the required track rigidity necessary for efficiently carrying loaded, rapidly-moving cars.

Further, the aperatured or grooved drive or guide wheels which engage or clear projecting drive pins on the track in the prior construction result in undesirable load-carrying or car drive characteristics for car drive and travel.

In addition, the rack pin drive projections and complementary slotted drive wheel arrangement in the prior construction are undesirable from many standpoints.

Also, the car movement control brush mounting on the car for contact with control strips in the prior construction, does not provide uniform contacting characteristics under all operating conditions.

Furthermore, the load carrying container in the prior construction does not allow container orientation in a horizontal or level position when the car is traveling in a vertical portion of the track system, and this is undesirable.

In addition, the prior construction does not have an adequate means for detecting an obstruction along the track system to prevent car or container or container contents damage.

Also, the prior system of Ser. No. 244,265 illustrates that the disclosed drive means inherently involves a shifting in the geometry of the location of the load or weight carried by the car and the relative location of track rails, etc., which changes the driving force geometry between the car and track as the car moves around bends. These characteristics are undesirable.

Accordingly, there is a need for easily-maintained equipment for automated, self-propelled car-track transportation systems that avoids the described difficulties and drawbacks, and permits conveying or distributing objects, materials or loads between stations in such systems effectively, efficiently, simply, economically and reliably; while retaining the desirable features, functions and characteristics of prior art systems and equipment.

SUMMARY OF THE INVENTION

Objectives of the invention include providing for automated, self-propelled car and track transportation systems, a new track structure which has a special rigid channel shape, preferably formed of metal, with an improved rail head contour in cross section including a car-guide-wheel-engaging replaceable, non-metallic, rounded wear strip, which may be readily assembled with staggered track section and wear strip joints, which is easy to mount and maintain track rail rigidity with the channel web vertically oriented at all times regardless of the vertical, horizontal or curved direction of car travel on the track, which insures effective friction drive contact of car drive and pressure rolls with engaged track rail surfaces, and which enables accurate mounting of control strips on the track structure at desired locations; providing for such systems a new car construction which has completely rounded-groove guide wheels in spring-pressed engagement with opposed rail heads, free of wheel cut-outs, to transfer the wheel load directly and efficiently centrally to the rail head rounded wear strips with a minimum of noise during car travel, which has direct mounting of contact strip brushes on the car body or chassis with individual brush adjustment and with brush contact points opposite an axis of an axle for one pair of guide wheels that engage opposite rail head portions, thereby to provide brush contact points that have a constant position with respect to the track, and which has an obstruction-detecting bumper construction, preferably on both ends of the car, that stops the car upon encountering an obstruction; providing for such systems a pivoted mounting and releasable suspension connection for a container on a car, which permits the container to retain an upright position with a preferably top opening door or closure regardless of the relative position of or direction of movement of the car, and which has an interlock between the container door and car drive mechanism so that the car can only move when the door is closed and locked; providing for such systems an interacting configuration of track and guide and drive wheels which is uniform regardless of the horizontal, vertical or curved direction of car movement to obtain the same driving characteristics for the car drive means at all times; providing for such systems an interrelated motor, drive wheel, and guide wheel construction for the car so that the driving force geometry remains constant with respect to the drive wheel and track, regardless of the car relation to the track; and providing new car and track structures for such systems which achieve the stated objectives in an effective, efficient and economical manner, and which solve problems, satisfy needs, and eliminate the described difficulties and drawbacks existing in the art.

These and other objects and advantages may be obtained by the new controlled self-propelled car transportation apparatus, the general nature of which may be stated as including in a transportation system of a type in which a car travels along a track system having horizontal and vertical track runs with curves between the runs and inside and outside corners between horizontal runs; channel track sections formed with spaced track rail heads having circularly rounded surfaces facing each other in spaced relation, means mounting the straight, curved and corner track sections with the channel web of each section oriented vertically throughout the track system; the rail heads including wear strips having the circularly rounded surfaces formed thereon; control strips having a series of spaced metal strip conductors mounted in predetermined locations along the track system; a car having a chassis and a pair of spaced swivel axle means mounted on the chassis having grooved guide rollers journaled on each end of each swivel axle means in spring-pressed engagement with rounded rail head surfaces mounting the car for travel on said track system; pinch roll friction drive roller means mounted on the chassis between the spaced swivel axle means having pressure roll driving engagement with one of the rail heads; the drive roller means including a pivot shaft, a drive motor pivotally and slidably mounted on said pivot shaft, and friction drive roller and pressure roll means driven by said motor in pinch roll driving contact with one of the rail heads; a plurality of contactor brush means pivotally mounted on the chassis on an axis parallel with a swivel axle axis, for contact with control strip spaced metal strip conductors; obstruction detecting bumper mechanism mounted on the car; a container for material to be transported pivotally mounted on the car; and the container having a door and interlock means between the door and drive motor preventing car movement unless the container door is closed and locked.

BRIEF DESCRIPTION OF THE DRAWINGS

A preferred embodiment of the invention — illustrative of the best mode in which applicants have contemplated applying the principles — is set forth in the following description and shown in the drawings and is particularly and distinctly pointed out and set forth in the appended claims.

FIG. 21 is a section taken on the line 21—21, FIG. 11, illustrating the track guide wheel assembly engaged with the track illustrated in dot-dash lines;

FIG. 22 is a fragmentary view looking in the direction of the arrows 22—22, FIG. 11, illustrating the brush contactors for car control;

FIG. 28 is a sectional view taken on the line 28—28, FIG. 11 showing the brush contactor mounting;

FIG. 29 is a diagrammatic elevation view of the geometry of the guide and drive rollers and track in a straight track run;

FIG. 30 is a view similar to FIG. 29 showing the guide and drive rollers moving around the small track radius of a curve;

FIG. 31 is a diagrammatic plane view of the geometry of the guide and drive rollers and track in a straight track run similar to FIG. 29;

FIG. 32 is a view similar to FIG. 31 showing the guide and drive rollers moving around an outside corner; and FIG. 33 is a view similar to FIGS. 31 and 32 showing the guide and drive rollers moving around an inside corner.

Similar numerals refer to similar parts throughout the various figures of the drawings.

DESCRIPTION OF THE PREFERRED EMBODIMENT

Figure 1:
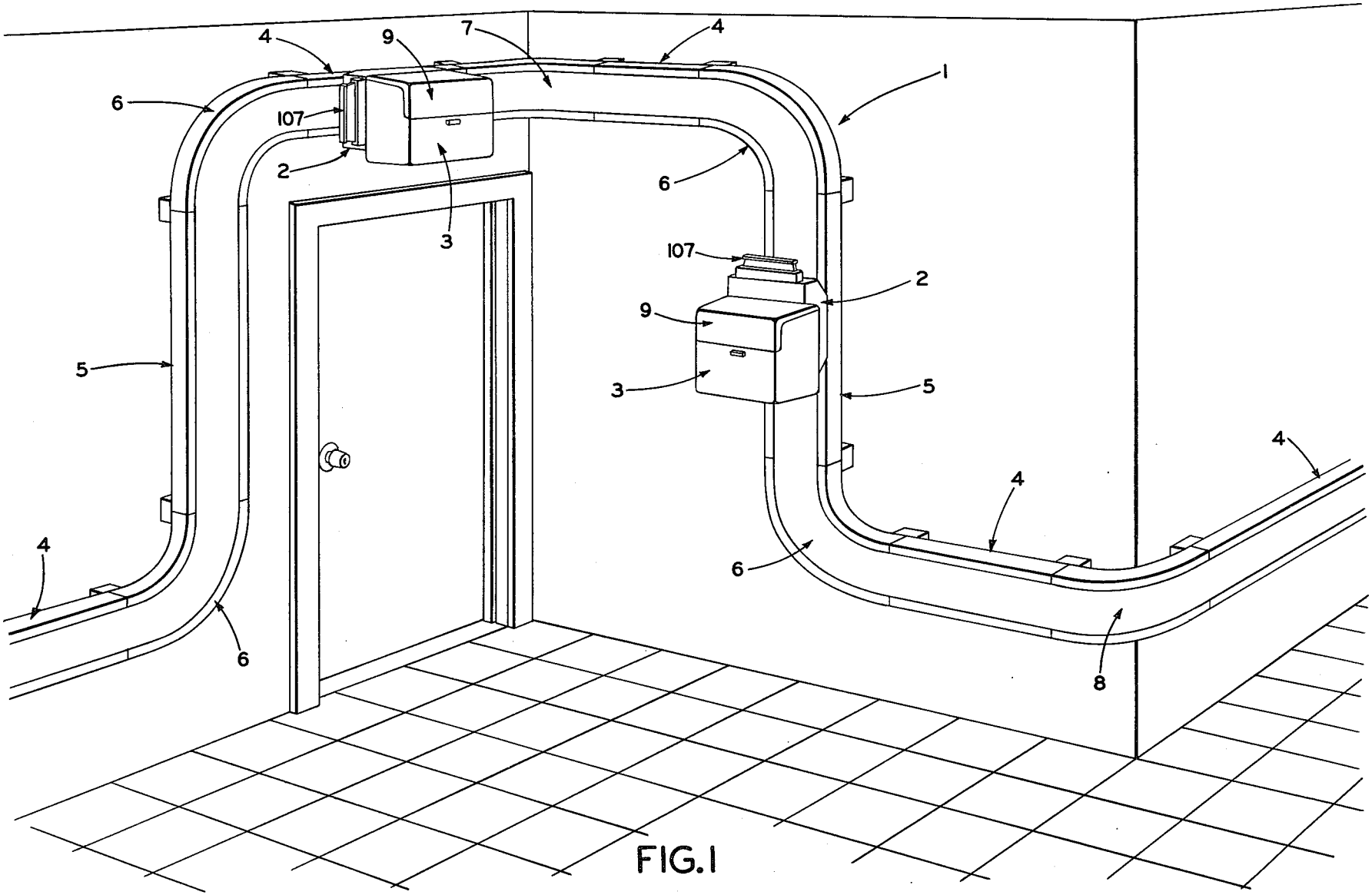
FIG. 1 illustrates portions of a building showing walls, a door, and inside and outside corners and showing the new track structure including horizontal and vertical track runs with bends between such runs, and inside and outside corner bends between horizontal track runs.

The new controlled self-propelled car transportation apparatus is generally illustrated somewhat diagrammatically in FIG. 1. The track system is generally indicated at 1, self-propelled cars traveling on the track system 1 are generally indicated at 2, and load-conveying containers carried by the cars are generally indicated at 3.

The track system 1 has horizontal and vertical track runs with bends or curves between such runs, and also has inside and outside corner bends between track runs.

In accordance with the invention, the tracks are made of sections that are channel-shaped in cross section, and the channels always extend with the channel webs extending vertically, whether the track is installed horizontally along a wall or is curved upward or downward or extends vertically along the wall, or curves around an inside or an outside corner, all as illustrated in FIG. 1.

Horizontal runs of the track system are generally indicated at 4 in FIG. 1 which also shows vertical runs generally indicated at 5. Bends or curves generally indicated at 6, connect horizontal and vertical runs. An inside corner is generally indicated at 7, and an outside corner is generally indicated at 8.

Although not shown, the track system 1 may extend between floors by mounting vertical runs to extend through openings formed in building floors and ceilings or through enclosed passages between floors. Similarly, the track system 1 may extend between separate rooms on any one floor of a building by mounting horizontal runs to extend through wall openings. Such openings or passages between floors or rooms are of sufficient size to permit passage of a car and a load-conveying container on the car. The track system also may have switches to connect branch tracks between various stations at various locations on the same or different building floors, and such switches may be of the general types shown in said application Ser. No. 244,265.

A fundamental facet of the invention is that containers 3 are pivotally suspended on the cars 2. This allows the container to remain level regardless of the car location in the track system, as illustrated by the two cars shown in FIG. 1, wherein one car is traveling horizontally while the other is traveling vertically. Thus, the load-conveying container 3 which remains level on the track system always has its lid, generally indicated at 9, at the top of the container 3.

TRACK CONSTRUCTION

The various track components 4, 5, 6, 7 and 8 of the track system 1 are formed in sections, preferably solid extruded aluminum sections, that are generally continuously channel-shaped in cross section. A standard track section, generally indicated at 10, is shown in FIG. 2 with portions of adjacent track sections 10-1 and 10-2 connected to the ends of the track section 10.

Figures 2, 3:
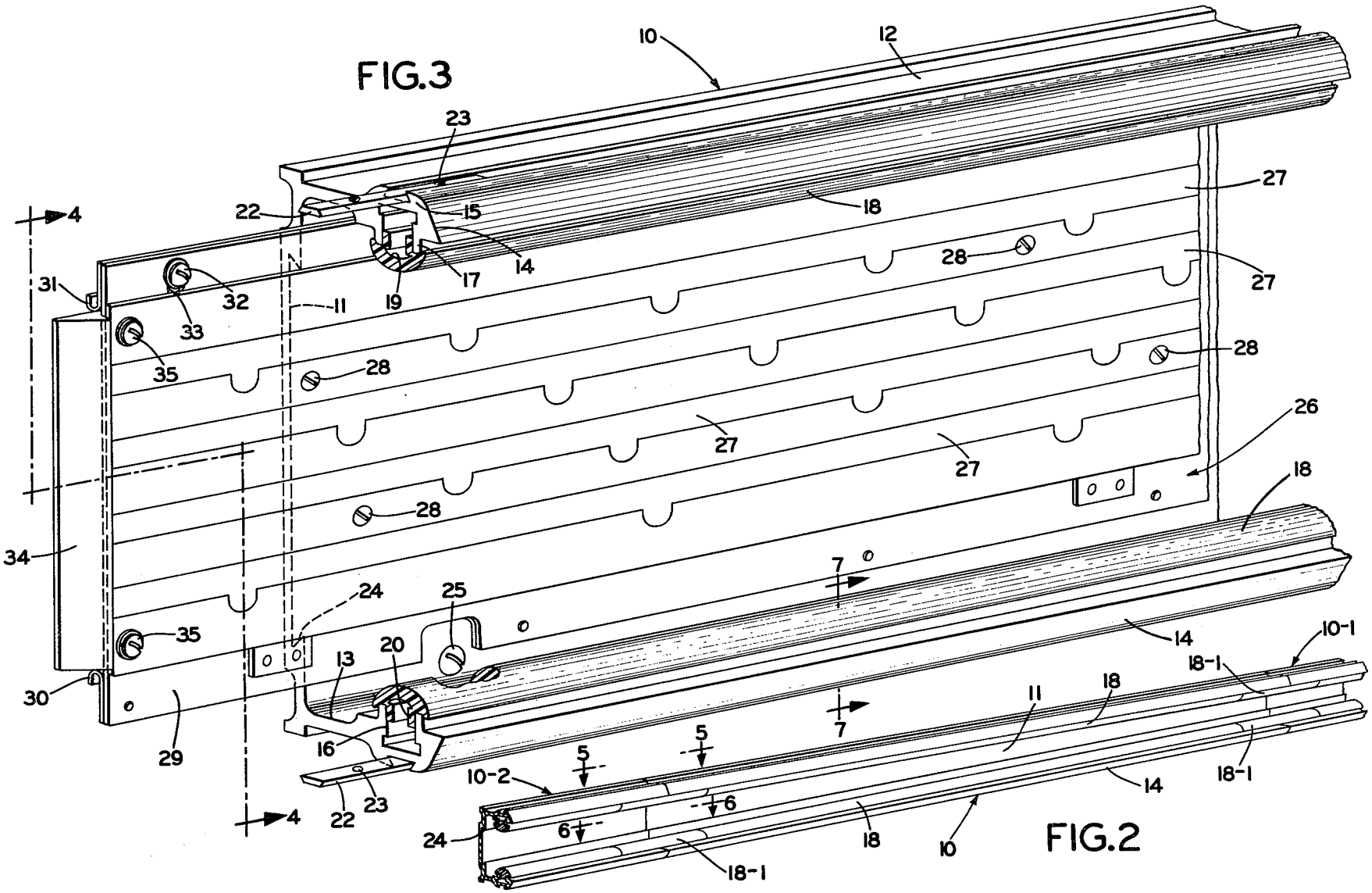
FIG. 2 illustrates a section of the new rigid channel-shaped track structure and assembled portions of adjacent track sections.
FIG. 3 is an enlarged perspective view of a portion of one end of a track section and illustrates a car travel control strip mounted on the track section.

Track sections 10, 10-1 and 10-2 are manufactured preferably in standard lengths such as ten-foot lengths of straight sections, as illustrated in FIG. 2. The bends or corner sections 6, 7 and 8 obviously have shorter lengths but have the same cross-sectional contour.

Figure 4:
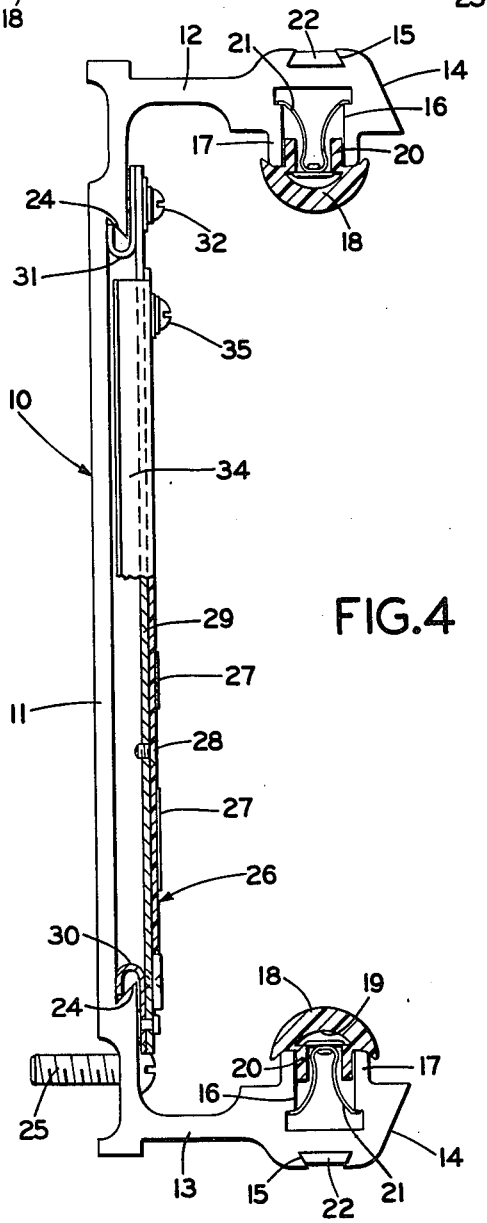
FIG. 4 is an end view, with parts broken away and in section, looking in the direction of the arrows 4—4, FIG. 3.
Figure 8:
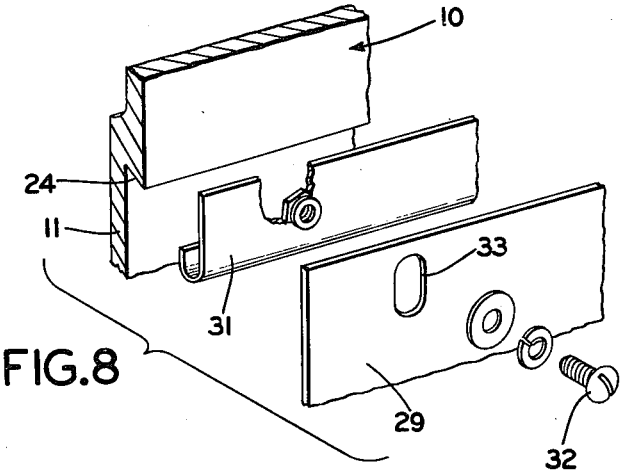
FIG. 8 is an exploded perspective view of fragmentary portions of the means for mounting a control strip at a desired location on the track.
Figure 7:
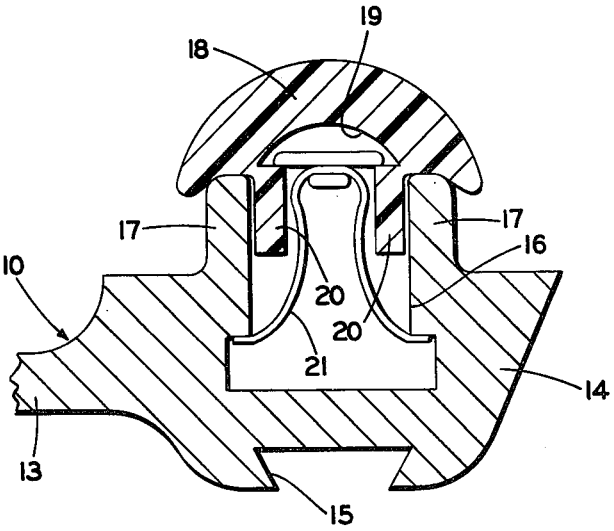
FIG. 7 is an enlarged fragmentary sectional view taken on the line 7—7, FIG. 3.

The cross-sectional contours of a track section 10 or portions thereof are best illustrated in FIGS. 3, 4 and 7. These contours or configurations include a continuous web 11 and upper and lower similar flanges 12 and 13 with reference to a track section 10 extending horizontally. The upper and lower flanges or spaced continuous channel legs 12 and 13 integral with the web 11 at their extremities have a special configuration in cross section to provide spaced rail heads 14. Each rail head 14 has an outer dovetail groove 15 formed therein and an inner T-shaped slot 16 provided with legs 17 (FIG. 7). The T-shaped slot 16 and legs 17 are directed and open toward each other, as best shown in FIG. 4.

Figure 6:
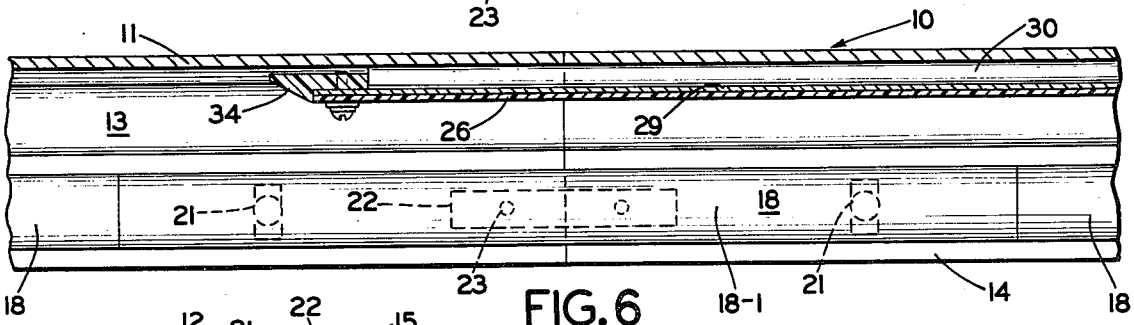
FIG. 6 is a view similar to FIG. 5 looking in the direction of the arrows 6—6, FIG. 2.

The rail heads 14 are provided with wear strips 18 assembled to the rail heads 14 and capable of being replaced. Wear strip 18 is formed preferably of a plastic material. The wear strips preferably are made in nine-foot sections and one-foot pieces, which are used to bridge joints between adjacent channel-shaped track sections 10, as illustrated in FIGS. 2 and 6 wherein a main wear strip section is indicated at 18, and bridge wear strip pieces are shown at 18-1. Thus, joints between track sections 10, etc. and wear strips 18, etc. are staggered when a track system is installed.

The wear strip 18 in cross section is half round (FIG. 7) and also has an undercut recess 19 formed by spaced leg members 20. The wear strip leg members 20 telescope between the rail head slot legs 17, and clips 21 engage the rail head T-slot 16 and the wear strip undercut 19, as shown, for assembling the wear strips 18 to the rail heads 14. When necessary to replace wear strips 18, they may be removed with a suitable tool. The clips 21 have the necessary flexibility to permit such removal.

Figure 5:
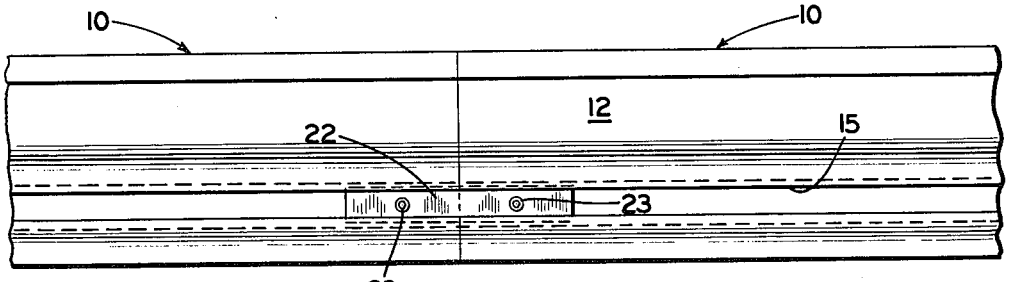
FIG. 5 is an enlarged fragmentary view looking in the direction of the arrows 5—5, FIG. 2.

Splice strips 22 extend in the dovetail grooves 15 of adjacent track sections 10 (FIG. 5) when a track system is installed, and set screws 23 or other fastening means may be used to secure the splice strips 22 in place. The web 11 of a track section 10 may be formed with a dovetail offset 24, and the track sections 10 may be bolted as indicated at 25 (FIGS. 3 and 4) to a building wall in installing a track system 1.

The track section construction provides a rigid structure giving stability and definite fixed locations of and spacing between opposite wear strips 18 on the opposed track rail heads 14. Thus, the track system is easy to mount while retaining rigidity.

The dovetail offset 24 in the channel web 11 provides undercuts that are used to mount car travel control strips at desired locations on the track for a purpose described below. One of such control strips is generally indicated at 26 and preferably is formed as plastic sheet material having metal strip conductors 27 applied to a surface thereof or embedded therein and extending longitudinally of the track on which the control strip 26 is mounted.

The control strip 26 may be bolted at 28 to a plate 29 which has a curved engaging flange 30 at its lower edge and a similar adjustable flange 31 at its upper edge. Engaging flange 31 may be adjusted by bolts 32 extending through elongated slots 33 formed near the upper edge of plate 29. Adjustment of the bolt and slot connection 32–33 permits the curved flanges 30 and 31 to be engaged with track section dovetailed grooves to mount the control strip 26 on the track.

A ram 34 is bolted at 35 to each end of the control strip plate 29 for a purpose described below.

One feature of the track construction is important. The wear strips 18 being formed of plastic material contribute to a low noise level characterizing operation of cars 2 on the track system.

CAR CONSTRUCTION

Figure 17:
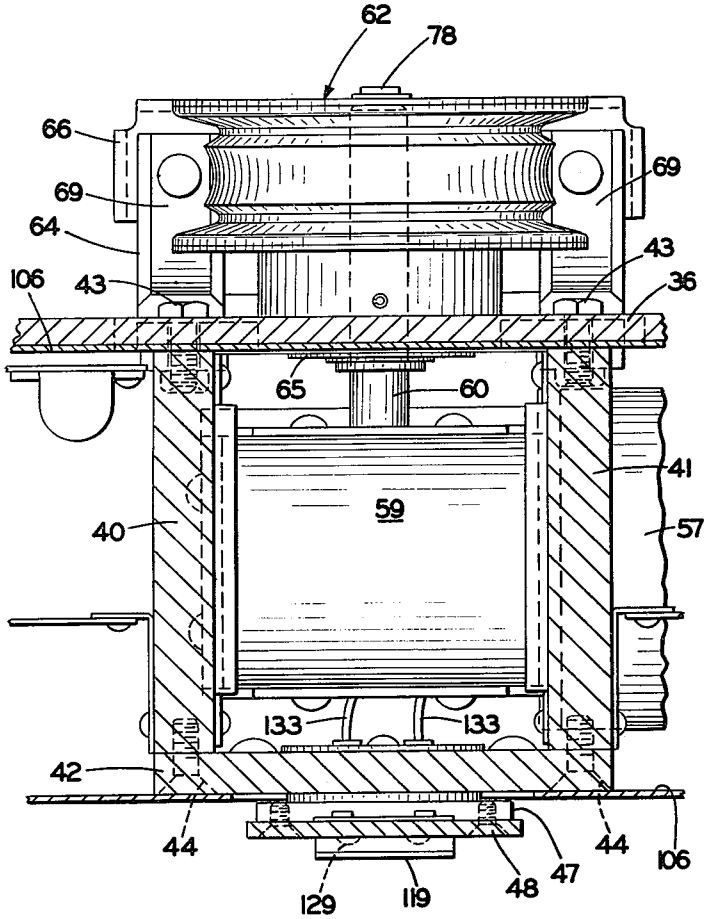
FIG. 17 is an enlarged fragmentary plan sectional view taken on the line 17—17, FIG. 16.

Car 2 has a chassis plate 36 which extends vertically at the rear of the car (looking at FIG. 11 and toward the left of FIG. 18), and the lower edge of plate 36 is cut out at 37 to provide a long leg 38 and a short leg 39. A box-like housing open at the top and bottom is formed by side plates 40 and 41 and a front plate 42 (FIGS. 17 and 18), and the side plates 40 and 41 are bolted at 43 to chassis plate 36, while the front plate 42 is bolted at 44 to the outer vertical edges of side plates 40 and 41. Front plate 42 has a downward extension 45 in which a bearing 46 is mounted which journals a pivot hub 47 to which a container mounting swivel plate 48 is fixed by screws 49 and bolt 50.

Figure 18:
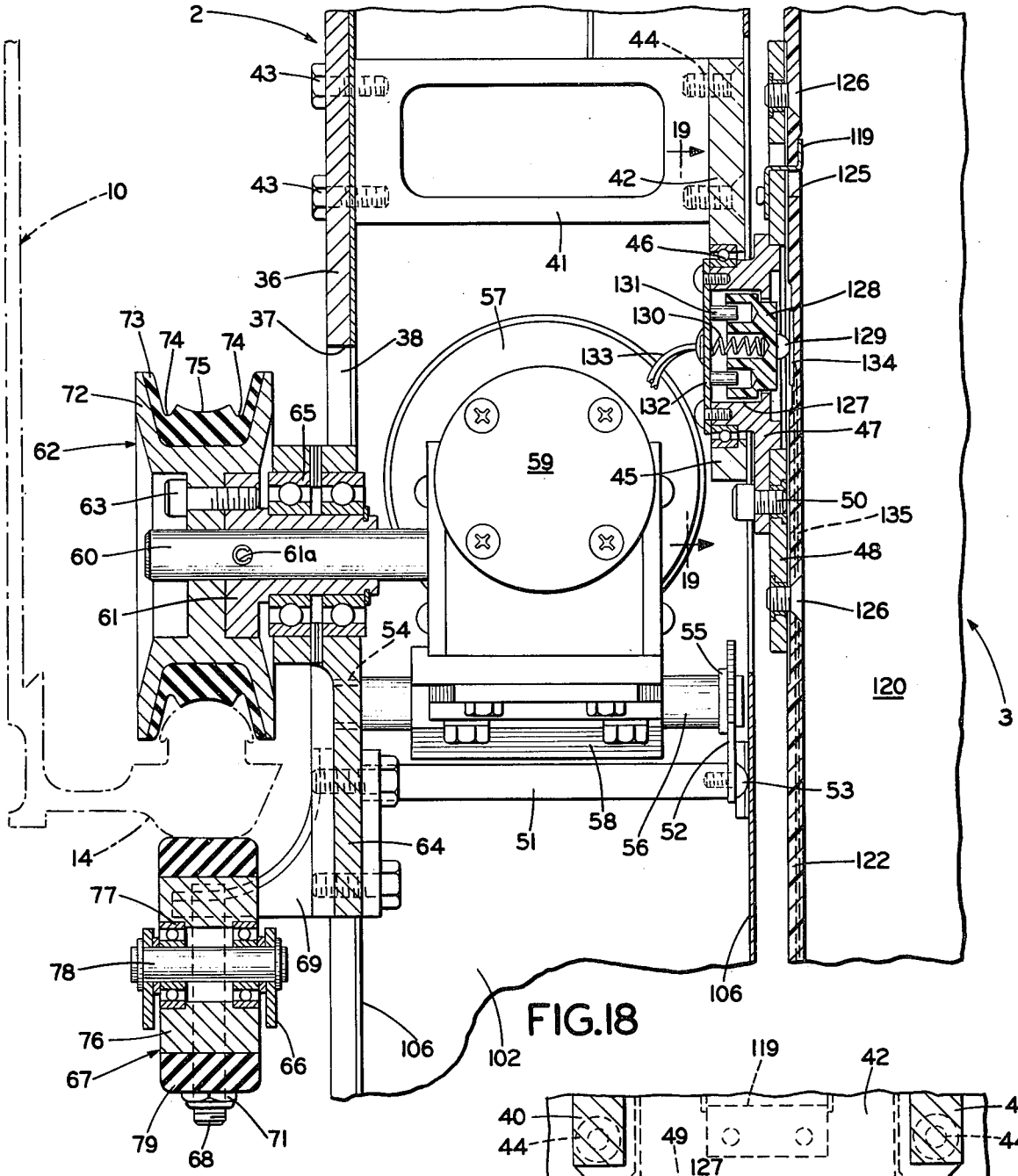
FIG. 18 is an enlarged vertical sectional view of certain of the components of the car, looking in the direction of the arrows 18—18, FIG. 16, and illustrating a portion of the track in dot-dash lines engaged by the car drive mechanism; and also showing a portion of a container mounted on the car.

A shelf-like bracket 51 is mounted on the front of the lower end of leg 38, and an upright flange plate 52 is mounted on the outer end of bracket 51 by screws 53. Chassis plate leg 38 and flange plate 52 are provided with bearings 54 and 55 journaling a pivot shaft 56 (FIG. 18). A drive motor 57 for the car 2 is mounted on a bracket 58, and the bracket 58 is journaled on pivot shaft 56 and is slidable axially of the shaft 56 in either direction from the central position illustrated in FIG. 18, for a purpose to be described.

The motor 57 includes a gear box 59 from which drive shaft 60 projects. A hub 61 is keyed at 61*a* to drive shaft 60. A friction drive roller generally indicated at 62, is bolted at 63 to the hub 61. An L-shaped idler wheel mounting member 64 is journaled on bearings 65 carried by hub 61 which suspend the mounting member 64 from the drive shaft 60 (FIG. 18).

A saddle 66 centrally journaling an idler wheel 67 is slidably mounted at its ends (FIGS. 11) on bolts 68 carried by the L-shaped mounting member 64. The saddle 66 is spring-pressed upwardly against the leg 69 of member 64 by springs 70. Nuts 71 on bolts 68 may be used to adjust the spring tension of springs 70 which bias the idler roll 67 upwardly (FIGS. 11 and 18) toward friction drive roller 62.

The friction drive roller 62 preferably has a metal V-like pulley body 72 and an annular rubber insert 73 having a special contour in cross section is bonded in the groove of the body 72. The insert 73 is undercut at 74 to present a more efficient rounded annular track contact driving zone 75 (FIG. 18).

The idler wheel 67 comprises preferably an annular metal ring member 76 journaled on bearings 77 carried by the pivot shaft 78 which mounts the idler wheel 67 on saddle 66. Idler wheel 67 preferably has a urethane tread 79 bonded to the ring; and idler wheel tread 79 preferably has an outer cylindrical surface, as shown.

Idler wheel 67, spring-pressed by springs 70, provides a pressure roll adapted to engage the underside of a rail head 14 of a track section 10, as shown somewhat diagrammatically in FIG. 18 wherein a part of a track section is indicated in dot-dash lines. The rounded drive zone 75 of friction drive roller 62 engages the half-round wear strip 18 of a rail head 14. When a car 2 is suspended from and running along the track system, the drive roller 62 and idler wheel 67 are tightly clamped against portions of a rail head 14 in friction driving engagement therewith.

The contour and structure of track sections 10 and the rail heads thereof, as described, provide a rigid rail member against which the friction drive roller 62 and idler wheel 67 establish effective pinch-like friction drive engagement that efficiently drives a car 2 along both horizontal and vertical runs 4 and 5 of the track system 1. This facet of the concept of the invention eliminates cut outs in the guide rollers 84 heretofore present in prior devices for engagement with pins on the track to enable the car to be driven in prior vertical track system runs.

The configuration of the track rail heads 14, of the drive roller 62, and of idler roll 67 are uniform irrespective of the location of a car 2 in a track system 1, such as illustrated in FIG. 1, whether the car is moving horizontally, vertically, or around a curve or a bend. Thus, the driving characteristics are the same at all times. Furthermore, even though the wear strips 18 on the track are replaceable, nevertheless, wear surfaces on the car also are replaceable and wear may be compensated for by replacing drive roller 62 or an idler wheel 67.

Figure 11:
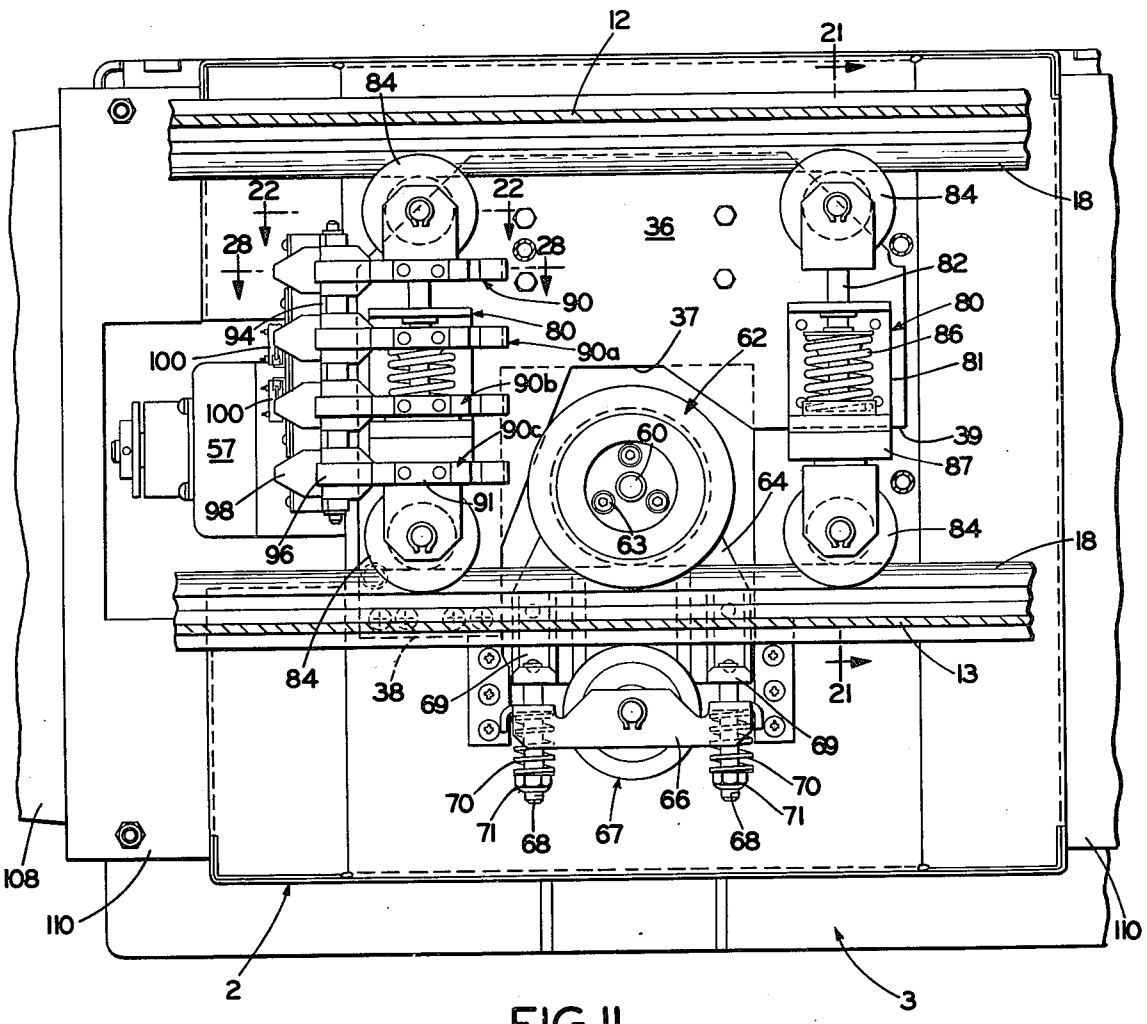
FIG. 11 is a sectional view on the line 11—11, FIG. 10, looking toward the back of the car.
Figure 10:
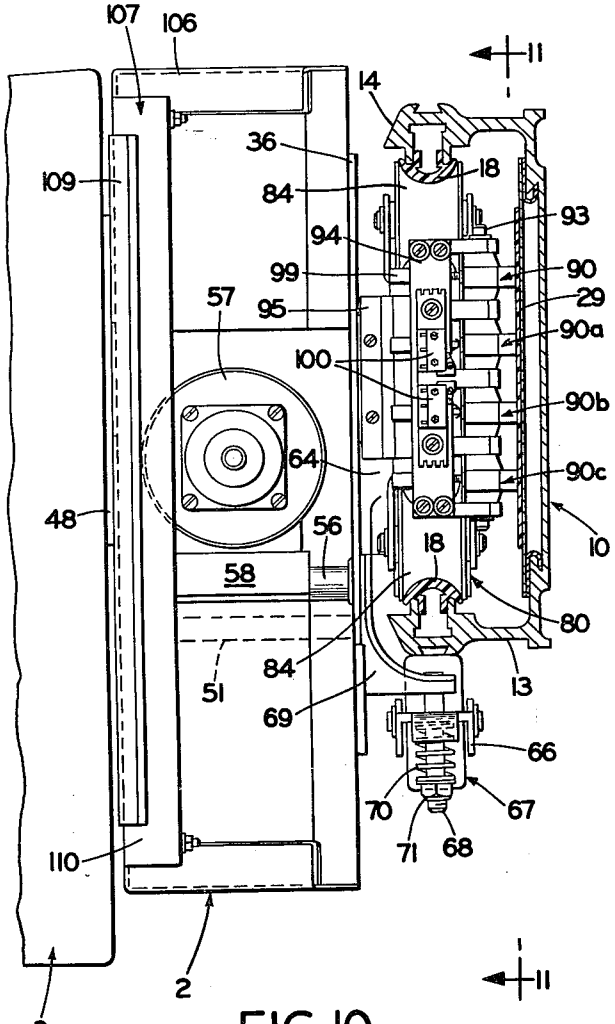
FIG. 10 is a side view of the car looking toward the right end of FIG. 9 on the line 10—10, FIG. 9.

The car 2 has a pair of guide wheel suspension assemblies, generally indicated at 80 (FIGS. 10, 11 and 21). Each assembly 80 includes a U-shaped bracket 81 projecting rearwardly from the rear of chassis plate 36. A swivel shaft 82 is journaled in bearings 83 in the legs of the bracket 81. A guide roller 84 is journaled at 85 on the upper end of swivel shaft 82. Shaft 82 is spring-pressed upwardly by spring 86, reacting against the lower leg of bracket 81.

Bearing retainer 87 is fixed to the underside of the lower leg of bracket 81 (FIG. 21). Bearings 88 are mounted in retainer 87 which journal a swivel thimble 89 carrying another guide roller 84. The lower end of swivel shaft 82 projects into and is movable axially of thimble 89. In this manner, the guide rollers 84 may be engaged with the wear strips 18 of the upper and lower rail heads 14 of a track section 10 in the track system 1, the rollers being biased against the rail heads 14 by the pressure of spring 86. Thus, the pair of guide roller assemblies 80 suspend the car 2 from the track, as shown in FIGS. 10, 11 and 21.

Each of the four grooved guide or track-engaging car suspension rollers or wheels 84 has a continuous rounded groove surface so as to completely engage the rounded portions of the track wear strips 18 providing maximum support for the car load. The swivel shafts 82 of the guide wheel suspension assemblies 80 are in spaced relation on the car 2 and normally extend vertically when the car is in normal position on a horizontally extending track section. The rollers 84 at the ends of each assembly are spring-pressed away from each other, as stated above, so as to be maintained in engagement with the spaced half-round wear strips 18 on the rail heads 14 of the track system 1.

The track-engaging grooves of the guide wheels 84 are completely rounded and thus are free of cut outs, which enables the wheel load to be transferred directly and centrally to the track wear strips. This avoids problems that have existed with cut-out wheels used in prior devices.

A series of contactor brushes 90, 90*a*, 90*b* and 90*c* is mounted directly on the car chassis with individual brushes spaced one above another (FIGS. 9, 10, 11 and 22). Each contactor brush 90, 90*a*, 90*b* and 90*c* includes a preferably copper shoe-like contact member 91 mounted on an insulating finger 92 pivotally mounted at 93 on an insulating bracket 94 carried by a mounting plate 95 extending from the left-hand U-shaped bracket 81 shown in FIG. 11.

The contact members 91 are connected with spring-like strip conductors 96 which bias the contactor brushes outwardly from the back of the car 2. The other ends of the spring conductors 96 provide terminals 97 located in bracket 94 for connection in the control circuitry for the car.

Each insulating finger 92 also is provided with a projecting ear 98 engaged by an adjusting screw 99 which adjusts the biased location of the finger 92 and also adjusts for wear on the contact member 91. The projecting ears also serve to actuate microswitches 100 (FIGS. 10 and 22) adjacent some of the contactor brushes 90, 90*a*, 90*b* and 90*c*.

The pivot axis of the brushes 90, 90*a*, 90*b* and 90*c* is parallel to the swivel shaft 82 of the adjacent guide wheel suspension assembly 80. Furthermore, each brush is individually adjustable for wear. The contact members 91 have ramps 101 (FIG. 22) for travel up and down the ramps 34 at the ends of the control strips 26 whose conductor strips 27 are engaged by a respective brush 90, 90*a*, 90*b* or 90*c*. In this manner, the contact zone between any contact member 91 on any of the contactor brushes and the metal strip conductors 27 is aligned with the swivel shaft 82 of the track-engaging wheels of the adjacent guide wheel assembly 80, so that the brush positions are constant with respect to the track. As stated, the ramps 101 on the contact members 91 ride up the ramps 34 provided at the ends of any control strip 26 and thence onto the control strip 26.

The drive motor mounting bracket 58, as described, is pivotally mounted on pivot shaft 56 and also is slidable axially or laterally of the shaft 56 in either direction from the normal central position (straight track run position) shown in FIG. 18. This mounting of the drive motor and the friction drive roller 62 and cooperating idler wheel pinch roll 67 has special significance in that it permits the motor and pinch roll drive 62–67 to accommodate car travel around bends or curves 6 and inside and outside corners 7 and 8 of the track system 1. For example, since the car is suspended from the track system 1 by a pair of guide and support wheel assemblies 80, which are spaced apart, the location of the roller drive 62–67 with respect to a fixed position on the car changes as the car moves around the curves or corners 6, 7 or 8. Thus, in moving around a bend or curve 6, the motor mounting bracket 58 pivots on shaft 56 to permit the drive roller 62–67 pinch engagement to move up or down, relative to the location of engagement with the track of one or another of the lower guide rollers 84.

Similarly, as the car moves around an inside or outside corner 7 or 8, the location of the drive roller 62–67 pinch engagement with the rail head 14 changes laterally in one direction or the other with respect to the engagement of the lower guide rollers 84 with the lower rail head 14. These location changes are accommodated by the slidability of the motor mounting bracket 58 laterally in one direction or the other on the pivot shaft 56.

The described capability of the drive motor mount to permit the driving engagement between the friction drive roller means 62–67 and the track, to shift during car travel around a curve or corner results in the ability to suspend the weight carried by the car 2 positively, while maintaining the driving force geometry constant. Thus, the cooperative relation between the track structure and the guide and drive roller construction and mounting provides driving characteristics that are the same at all times.

The car 2 has a compartment 102 (FIGS. 16 and 18) located below the motor 57 where a battery (not shown) may be installed which supplies power for the drive motor 57.

Figure 16:
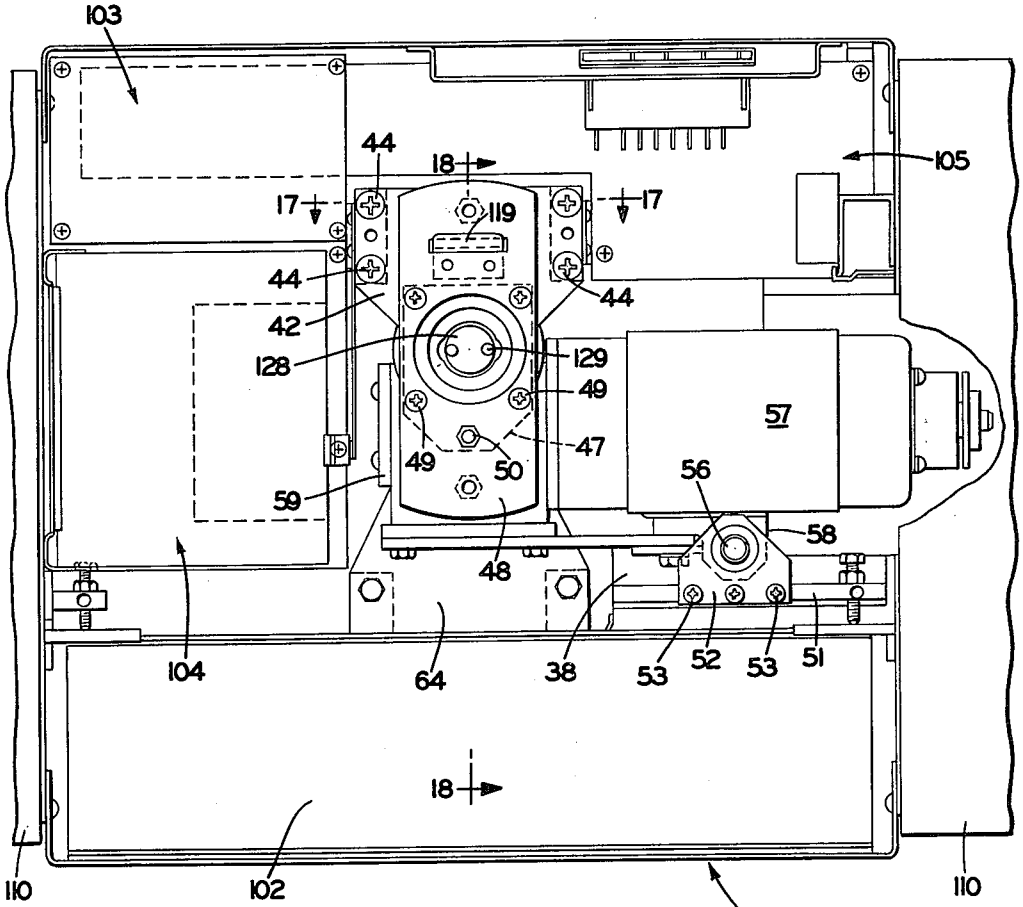
FIG. 16 is an elevation view of some of the components of the car, looking at the front of the car with the cover removed.

Other compartments in the car, as indicated generally at 103, 104 and 105 in FIG. 16, may contain circuit boards, electronic components, wiring, etc., which form part of the control system for operation and use of the car 2 and many similar cars on the track system 1. The various compartments of and components mounted in the car 2 may be enclosed by cover or housing means 106.

The car 2 is equipped with a bumper or obstruction-detecting mechanism, generally indicated at 107, at either one or both ends of the car, as shown in FIGS. 9 and 12 through 15. The bumper mechanism preferably includes a feeler bar 108 having a protective edge strip 109 slidably mounted in and projecting from a bumper housing 110.

Figures 9, 12, 13, 14, 15:
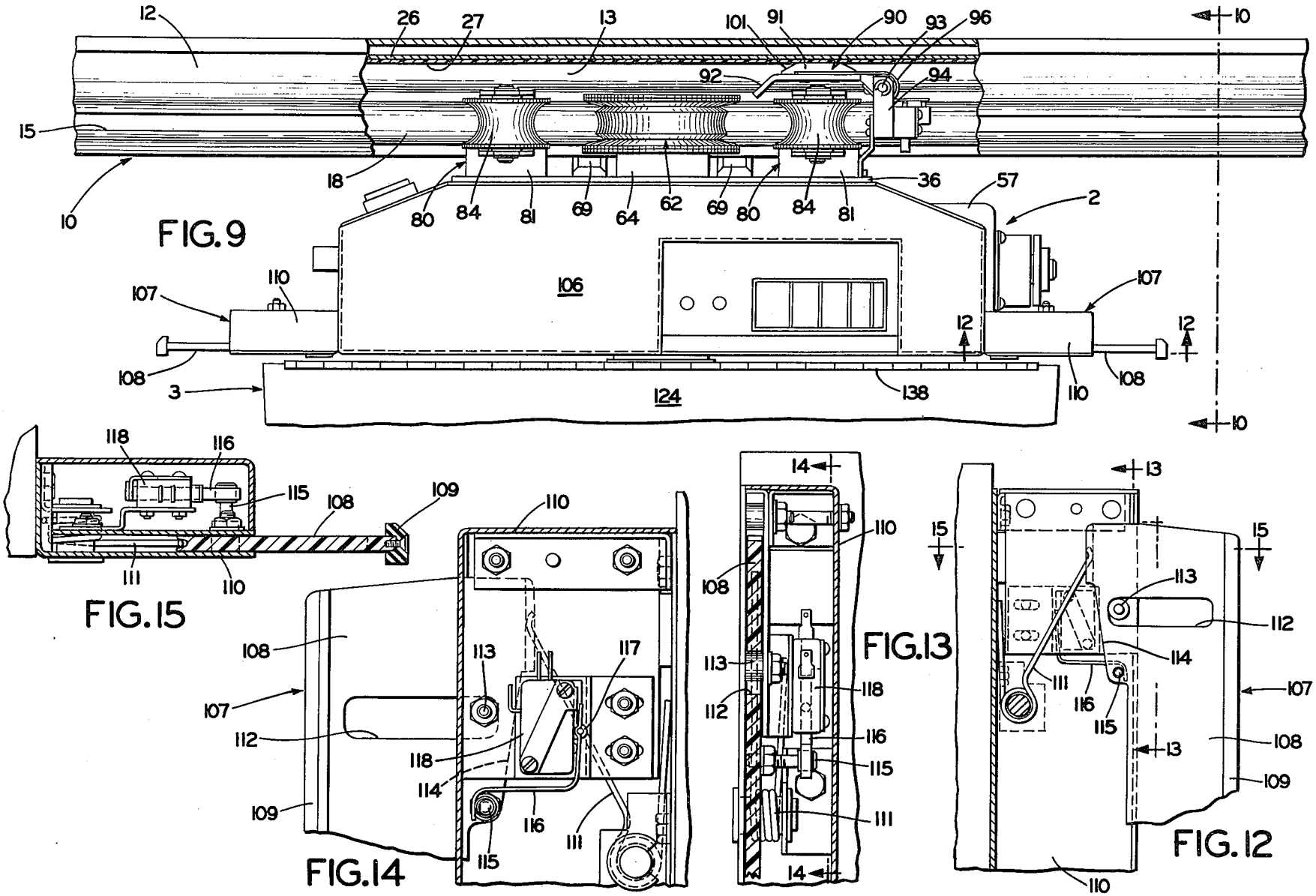
FIG. 9 is a top plan view of the improved self-propelled car with parts of the track section broken away to illustrate travel of the car on the track.
FIG. 12 is a fragmentary section looking in the direction of the arrows 12—12, FIG. 9, illustrating the obstruction detector means for the car.
FIG. 13 is a sectional view taken on the line 13—13, FIG. 12.
FIG. 14 is a sectional view taken on the line 14—14, FIG. 13.
FIG. 15 is a sectional view looking in the direction of the arrows 15—15, FIG. 12.

The bumper feeler bar 108 is freely movable in housing 110 and is spring-pressed or biased to extended or projected position by springs 111. The spring at the upper end of the housing 110 is shown in FIG. 14 and a similar construction is located at the lower end of the housing 110. General movement of bar 108 is controlled as to limits of movement by elongated rectangular slots 112 formed in the bar 108 adjacent the top and bottom ends thereof. A pin 113, mounted in housing 110, extends through each slot 112.

There is flexibility of movement of the bar 108 from any pressure applied in any direction to the edge strip 109 on the bar. In other words, the bar 108 can angle out of vertical position and move inward of the housing if one corner of the bar or a point on the strip 109 adjacent a corner encounters an obstacle.

The upper and lower ends of the bar 108 within the housing (full lines in FIG. 12) is irregularly formed at 114. A pin 115 projects laterally of the bar from the formation 114 into an adjacent portion of the compartment within housing 110 and engages a Z-shaped lever 116 pivotally mounted at 117 on microswitch 118 located in housing 110.

Z-shaped lever 116, pivotal mounting 117, microswitch 118, and lever actuator pin 115 similarly are located at the lower end of the housing, the upper end of which is shown in FIGS. 12 and 14. The details of the bumper mechanism 107 at the left end of the car 2 in FIG. 9 have been described with reference to FIGS. 12 through 15. The car may be equipped with one bumper mechanism 107, although it is desirable to use bumper mechanisms 107 at each end of the car, as shown in FIG. 9. The construction is the same for both bumper mechanisms if two are used.

All of the switches 118 in the bumper mechanisms 107 are wired in circuitry that will immediately stop the drive motor 57 in event that a bumper bar 108 encounters an obstruction, such as a stopped or stalled car 2 in the path of travel of a moving car. Contact of the bar 108 with an obstruction while the car is moving, moves the bar 108 into housing 110, and pin 115 releases lever 116 and permits actuation of switch 118 to a condition other than normal which, as indicated, controls the operation of the drive motor for the car.

CONTAINER CONSTRUCTION AND MOUNTING

The container swivel mounting plate 48 (FIGS. 16 to 20) mounted on pivot hub 47 is pivotally mounted on bearings 46 on the car 2. Swivel plate 48 has a hook member 119 used to suspend and mount a container 3 on the car.

Container 3 has side walls 120, a bottom wall 121, a rear wall 122, a front wall 123, and an L-shaped cover 124. The rear container wall 122 is formed with a hanger slot 125, which engages swivel plate hook member 119 to suspend or hang container 3 from swivel plate 48. This permits the container to be removed from the car 2 when necessary. However, normally the container 3, after being engaged with and hung on hook 19, is semi-permanently mounted on swivel plate 48 by screws 126 extending through the rear container wall 122 and engaged with swivel plate 48.

Figure 20:
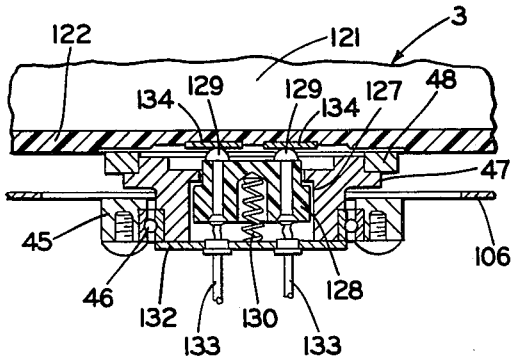
FIG. 20 is a fragmentary sectional view taken on the line 20—20, FIG. 19.
Figure 19:
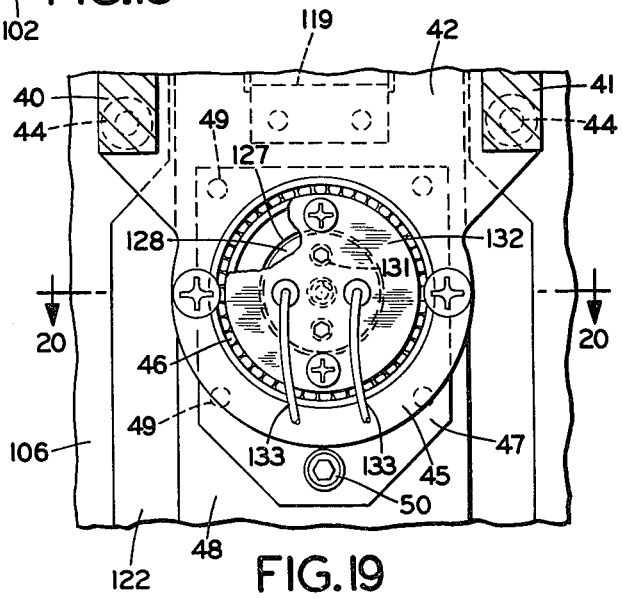
FIG. 19 is a fragmentary view looking in the direction of the arrows 19—19, FIG. 18, illustrating components of the pivotal mounting of the container on the car.
Figure 27:
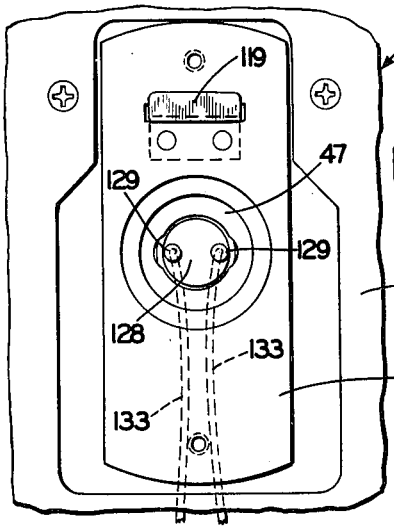
FIG. 27 is a view similar to FIG. 26 on the same scale illustrating the complementary portions of the car of the mounting means for the container on the car.
Figure 26:
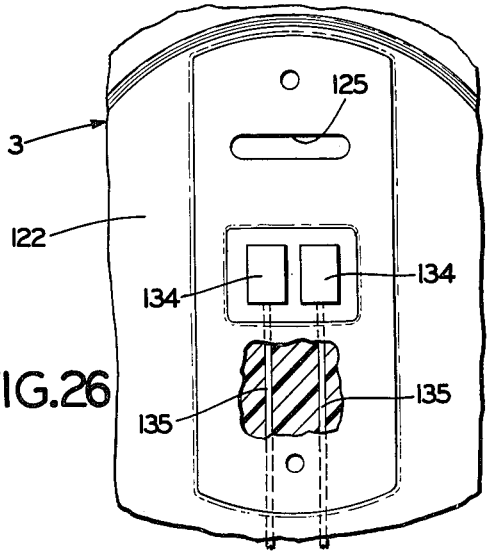
FIG. 26 is an enlarged fragmentary view of a portion of FIG. 25.

The pivot hub 47 (FIGS. 18 and 20) has a central annular shouldered passageway 127 formed therein in which a movable insulated contactor mounting member 128 is located. Member 128 is provided with two contact buttons 129 (FIGS. 16, 18 and 27) which project outward from the front of swivel plate 48. The contactor member 128 is biased outward by spring 130 in passageway 127 (FIGS. 18 and 20).

Insulated contactor member 128 is held non-rotatably in pivot hub 47 by pins 131 mounted on the back plate 132 of pivot hub 47. In this manner, the contact buttons 129 are located on a horizontal line running through the center of pivot hub 47 perpendicular to the vertical centerline of swivel plate 48. Conductor wires 133 are connected with contact buttons 129 and extend through the pivot hub backplate 132 into the interior of the car 2, as shown in FIGS. 17 to 20.

Figure 23:
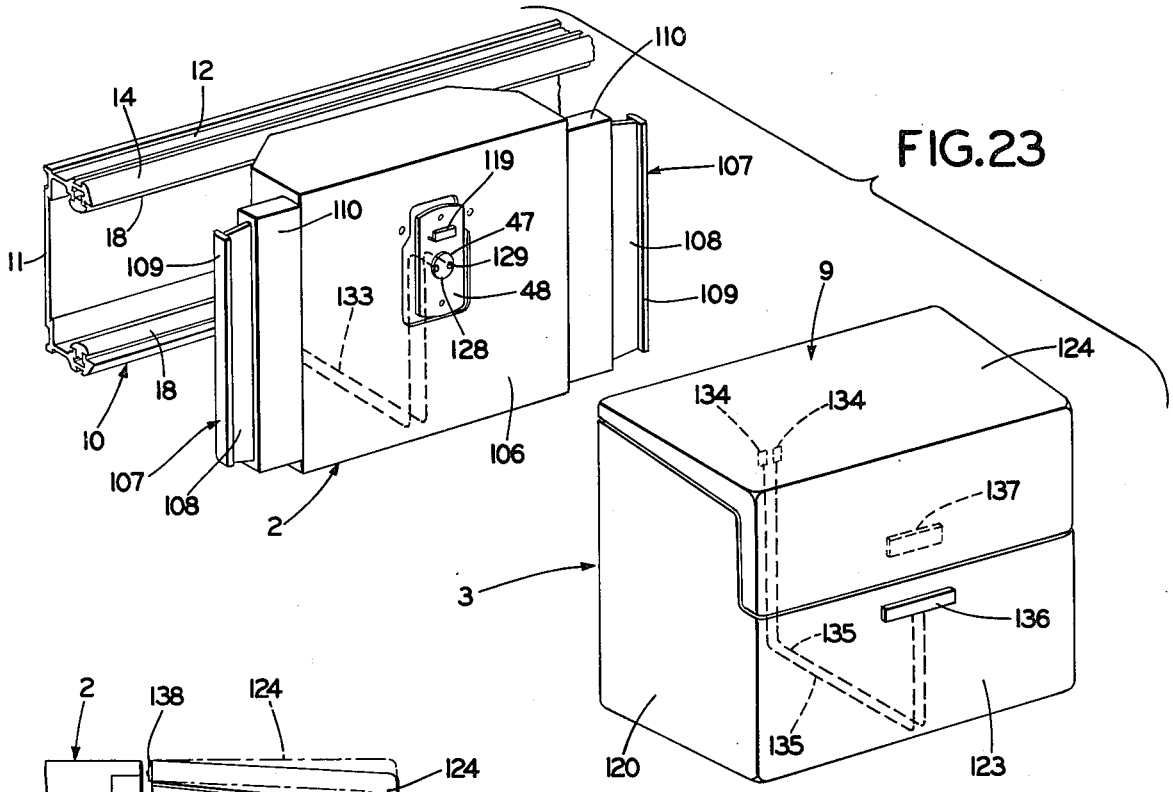
FIG. 23 is an exploded perspective illustrating the container detached from a car mounted on the track.
Figure 24:
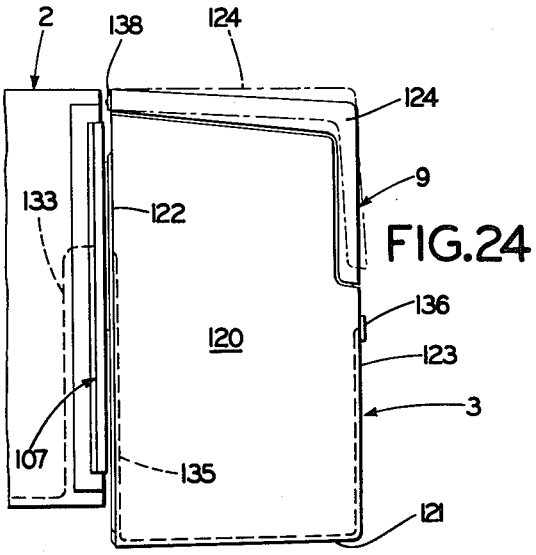
FIG. 24 is an end view of the container illustrated in FIG. 23 with the container lid shown in dot-dash lines in open position.
Figure 25:
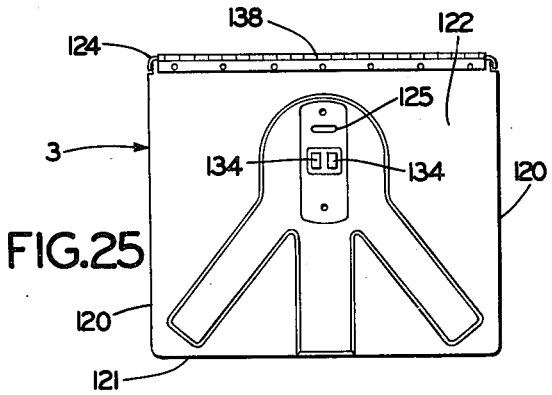
FIG. 25 is a rear elevation of the container shown in FIG. 23 detached from the car.

A pair of contact wafers 134 are embedded in the rear wall 122 of container 3, and wire conductors 135 connected with wafers 134 also are embedded in the rear wall 122, the bottom wall 121, and the front wall 123 of container 3, as shown in FIGS. 23 and 24. The other ends of wire conductors 135 are connected with a reed switch (not shown) adjacent the latch 136 for the container cover 124. The cover 124 may have a magnet 137 interiorly mounted thereon, located adjacent the latch 136 when the cover is closed and latched. Preferably, the hinge 138 for the container cover 124 is controlled by a spring which holds the cover 124 partially open, except when latched.

When the cover 124 is closed and latched by latch 136, the magnet 137 closes the reed switch, completing a circuit from one contact wafer 134 through one wire conductor 135, the reed switch, and back through the second conductor 135 to the second wafer 134. When the cover 124 is unlatched and partially open, as described, the magnet 137 fails to hold the reed switch in closed position, thus opening the container circuitry 134–135 described.

When a container 3 is mounted on and suspended from swivel plate 48, spaced contact wafers 134 on the container 3 engage contact buttons 129 on the pivot hub 47, thus connecting the described container circuitry 134–135 through the contact buttons 129 to conductor wires 133 (FIG. 20).

Conductors 133 are connected to the control circuitry for the operation of the car 2. If at any time the container 3 mounted on a car 2 has its lid in an unlatched and therefore partially open position, the reed switch controlled by the magnet 137 is opened, and the circuit to conductors 133 is opened to the car control circuitry, which prevents the drive motor 57 from being operated.

This safety feature, in addition to the safety feature provided by the bumper mechanisms 107, prevents damage or injury to the car 2, the container 3, and the contents of the container. It insures that the container will always be closed with its cover latched whenever the container and the car on which it is mounted are moving.

Furthermore, the swivel or pivoted suspension of the container 3 on the car 2 by the swivel plate construction and mounting described allows container orientation in the horizontal or level position when the car is traveling in the vertical portion of the track system, as indicated for example in FIG. 1.

Thus, the pivoted container mount enables the container to remain level at all times, and the interlock described between the container cover and the car drive motor prevents the car from moving unless the container cover is closed and latched.

Control strips 26, their metal strip conductors 27, the contact brushes 90, **90*a*, 90*b* and 90*c* and their contact members or shoes 91 have been described and illustrated; and FIG. 9 shows a shoe 91 in contact with a strip contactor 27 of a control strip 26**.

These control strips, with their respective components, are located along the track system 1 at or adjacent various stations or switches and form a part of the car movement control circuitry.

The contact shoes 91 ride up a ramp 34 at one end of a control strip 26 as a car approaches such control strip. Contact between the shoes 91 and the control strip-strip conductors 27 and activate car control circuitry. One or more of the shoe contacts with the strip conductors 27 permit a normally closed switch to open which signals the control circuitry that a car 2 is located at the particular control strip 26.

Each car is equipped with a read board and other electronic components including a series of reed switches in the control circuitry. The system for controlling movement of the car, including the control circuitry mentioned, forms no part of the present invention, but such system may be that shown in Vis U.S. Pat. No. 3,842,744.

IN GENERAL

In accordance with the concepts of the invention, the various track structures, car structures and components, container structures and the coordinated relationships between the described track, car and container elements described provide a new conveyor system in which a self-propelled car and a load-carrying container suspended from the car can travel along a track having horizontal and vertical track runs with curves between such runs and inside and outside corner bends between horizontal track runs while the container remains level regardless of car location in the track system; provide a track which is generally channel-shaped with spaced rail heads and in which the channel web always is vertically oriented throughout the system, in which the track is formed in sections with replaceable wear strips on the rail heads and with staggered non-registering track section and wear strip joints; provide track sections which accommodate the mounting of car travel control strips at desired locations in the system, with car movement control brushes mounted on the car to engage the control strips; provided rounded groove guide wheels which support the car on the track, and motor-driven friction pressure roll means which engage and drive the car along the track system with uniform driving force geometry regardless of car relation to the track; and provide safety devices which prevent car movement if the container cover is not closed and latched, and which detect obstructions that stop car movement to prevent car damage when an obstruction is encountered.

One particular and important aspect of the concepts of the invention involves the provision of a cooperative relation between the track structure and guide and drive rollers which permits the driving force geometry to remain constant regardless of the nature of the track along which the car is traveling, that is along straight track runs, around inner or outer curves or around outside and inside corners.

This capability is shown diagrammatically in FIGS. 29 through 33. In FIG. 29, the spacing between a horizontal line 139 through the center of a drive roller 62 and a similar line 140 through the centers of guide rolls 84 traveling along a straight track section run 10 is indicated at S.

Compare the spacing S with the spacing S+ in FIG. 30 between the same components with the car traveling around the smaller or inner radius of a curve such as the curves 6 shown above the door in FIG. 1. A spacing S-, less than the spacing S, results when the car is traveling around the larger or outer radius of a curve, indicated in dot-dash lines in FIG. 30, and such as illustrated near the floor to the left of the door in FIG. 1.

This change in the relative location of the drive roller 62 on the car with respect to the guide rollers 84 is made possible by the pivotal mounting of the drive motor bracket 58 on pivot shaft 56 (FIG. 18).

FIG. 31 shows the aligned relation, looking down on the rollers, of the drive roller 62 and guide rollers 84 on a straight track section run 10. Compare FIG. 32 wherein the location of the drive roller 62 moving around an outside corner 8, shifts in the direction of the arrow 141 with respect to a horizontal line H passing through the centers of the guide rollers 84.

Again, compare FIG. 33 with FIGS. 31 and 32 wherein the drive roller 62 shifts in the other direction shown by the arrow 142, when traveling around an inside corner such as the corner 7 of FIG. 1, with respect to the horizontal line H. This capability of lateral shifting of the drive roller 62 in either direction (arrows 141 and 142) from the straight run track position of the rollers (FIG. 31) is made possible by the slidable mounting of drive motor bracket 58 on pivot shaft 56 from the position shown in FIG. 18.

In this manner, the driving force geometry remains constant with respect to the drive wheel and track regardless of the car relation to the track. That is, the drive wheel does not tilt out of an upright position to negotiate a bend or curve.

Finally, the improved constructions achieve the objectives stated, eliminate difficulties that have been encountered with prior devices, and solve problems and obtain the new results described.

In the foregoing description, certain terms have been used for brevity, clearness and understanding; but no unnecessary limitations are to be implied therefrom beyond the requirements of the prior art because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the apparatus and its components are assembled, combined and operated, and the advantageous, new and useful results obtained; the new and useful structures, devices, elements arrangements, parts, combinations, systems, equipment, operations and relationships are set forth in the appended claims.

We claim:

1. In controlled self-propelled car transportation apparatus of the type in which a car travels along a track system having horizontal and vertical track runs with curves between the runs and inside and outside corners between horizontal runs; the track system including connected, straight, and curved corner track sections; each section being formed as a continuous rigid channel; the channel having a continuous web and two spaced continuous legs integral with the web terminating in free ends; the free ends of the legs being formed as rail heads having inner circularly rounded and outer surfaces; opposite rail heads having their rounded surfaces facing each other in spaced relation; means mounting the connected continuous straight, curved and corner track sections to form a track system; and the channel web, when mounted, of each section being oriented vertically throughout the entire track system.

2. The construction defined in claim 1 in which spline means engage and connect the ends of adjacent track sections to join such track sections together to form a track system.

3. The construction defined in claim 1 in which dovetail grooves are formed in the outer rail head surfaces; and in which spline strips are located in the dovetail grooves of and are secured to the ends of adjacent track sections to join such track sections together to form a track system.

4. The construction defined in claim 3 in which the outer rail head surfaces have flat areas, and in which the dovetail grooves are formed in said flat areas.

5. The construction defined in claim 1 in which wear strips provided with circularly rounded surfaces are removably mounted on the rail heads to form the inner circularly rounded rail head surfaces.

6. The construction defined in claim 5 in which the track channel sections are formed of extruded aluminum, and in which the wear strips are formed of plastic material.

7. The construction defined in claim 5 in which the wear strips and track channel sections have joints between abutting ends of adjacent strips and sections; and in which the wear strip joints are staggered with respect to the track channel section joints.

8. The construction defined in claim 5 in which the rail heads are formed with longitudinally extending slot means spaced from and facing each other; in which the wear strips have spaced leg members telescoped in said slot means; and in which clip means removably engage the rail head slot means and wear strip leg members to secure the wear strips to the rail heads.

9. The construction defined in claim 8 in which the rail head slot means comprise T-slots, in which the wear strips are formed with an undercut recess adjacent the leg members and in which the clip means extend between the leg members and resiliently engage the T-slots and recesses to secure the wear strips to the rail heads.

10. The construction defined in claim 1 in which the channel web is formed with an offset dovetail contour extending in cross section between zones adjacent the channel legs; in which control strips having a series of spaced metal strip conductors thereon are mounted at predetermined locations along the track system; in which the control strips have hook means along longitudinal edges thereof; and in which the hook means are longitudinally engaged with the channel web dovetail offsets for mounting the control strips on and immediately adjacent the channel web of a predetermined track section in the track system.

11. The construction defined in claim 10 in which the hook means along one edge of the control strips is adjustable for removably mounting the control strip on the channel web.

12. The construction defined in claim 10 in which ramp means are mounted on each end of the control strip adapted to engage and guide contactors carried by a car traveling along the track system onto and off of the ends of the control strip.

13. In controlled self-propelled car transportation apparatus of the type in which a car travels along a track system having vertical aligned spaced track rail heads formed with convex semicircularly rounded surfaces facing each other in spaced relation; the car including a chassis; a pair of spaced swivel axle means mounted on the chassis; guide rollers journaled on each end of the swivel axle means normally biased axially away from each other; each guide roller being formed with a smooth concave groove continuously semicircularly rounded in cross section; the semicircularly rounded guide roller groove cross section maintaining complete rounded surface engagement with the semicircularly rounded track rail head surfaces at all times during car travel throughout the track system, thereby transmitting the car load to one of the track rail heads directly and uniformly throughout contacting semicircularly rounded guide roll and rail head surfaces.

14. The construction defined in claim 13 in which a pair of U-shaped brackets are mounted on the car chassis in spaced relation; in which the U-shaped brackets have spaced legs through which the swivel axle means extend; in which the swivel axle means include a swivel shaft and a swivel thimble journaled on the U-shaped bracket legs; in which the swivel shaft is axially movable telescopically in the swivel thimble to accommodate biased relative axial movement of the guide rollers journaled on the ends of the swivel axle means; and in which spring means located between the spaced bracket legs reacts between the swivel shaft and swivel thimble to bias the guide rollers away from each other.

15. The construction defined in claim 13 in which friction drive roller means are mounted on the chassis between the spaced swivel axle means; in which the drive roller means includes a friction drive roller and a pressure roll engageable with one of the rail heads to move the car along the track system upon rotation of the drive roller; in which the drive roller has an annular track-engaging groove having a contour in cross section including a circularly rounded driving zone extending between annular undercut grooves; in which the drive roller groove is formed of resilient material; in which the rounded drive roller driving zone engages a circularly rounded surface of one of the track rail heads; in which the drive means pressure roll engages an outer surface of said one rail head; and in which said pressure roll is biased toward said friction drive roller to establish pinch roll friction driving engagement of the drive roller means with said one rail head.

16. The construction defined in claim 15 in which the pressure roll has a cylindrical rail head engaging surface; in which the pressure roll engaging surface is formed of plastic material; and in which said cylindrical engaging surface engages flat areas of said one outer rail head surface.

17. The construction defined in claim 15 in which the friction drive roller means includes a pivot shaft mounted on the car chassis, a motor mount bracket pivotally and slidably mounted on said pivot shaft, a drive motor mounted on said bracket, and a drive shaft extending from said drive motor; in which the friction drive roller is fixed to said drive shaft; in which a mounting member is journaled on said drive shaft adjacent said friction drive roller; and in which said pressure roll is journaled on said mounting member aligned with said friction drive roller.

18. The construction defined in claim 17 in which the mounting member is an L-shaped member having an angular leg projecting beneath the friction drive roller; in which spaced elongated bolt means project from said leg; in which a saddle is adjustably mounted on said bolt means for movement toward and away from said friction drive roller and normally biased toward said drive roller by spring means carried by said bolt means; and in which the pressure roll is journaled on said saddle.

19. The construction defined in claim 17 in which the circularly rounded rail head surfaces are formed of plastic material wear strips; in which the pressure roll has a plastic material cylindrical rail head engaging surface; in which the guide rollers are formed of plastic material; in which the friction drive roller has an annular rubber insert which forms the resilient material contoured track engaging groove; and in which the pivotal and slidably mounting of the motor mount bracket on the pivot shaft allows the pinch roll driving force geometry to remain constant with respect to the friction drive roller and engaged track rail head regardless of the car location on straight, curved or corner track sections forming the track system; whereby a low noise level exists during car travel along the track system.

20. In controlled self-propelled car transportation apparatus of the type in which a car travels along a track system provided with channel track sections formed with spaced track rail heads having circularly rounded surfaces facing each other in spaced relation; the car including a chassis; spaced brackets mounted on the chassis; swivel axle means mounted on each bracket; guide rollers having grooves journaled on each end of each swivel axle means; the guide roller grooves having spring-pressed engagement with rounded rail head surfaces; control strips having a series of spaced metal strip conductors thereon mounted between the rail heads on the web of channel track sections at predetermined locations along the track system; a plurality of contactor brush means pivotally mounted on one of the brackets on an axis parallel with the swivel axle axis; each brush means including a pivoted insulating finger having a contact member, a spring strip conductor connected with the contact member biasing the contact member pivotally away from the swivel axle means; and means for adjusting the biased location of each finger to provide the same constant location of all contact members with respect to the track; whereby the contact members uniformly engage respective spaced metal strip conductors on a control strip approached by a car traveling along the track system.

21. The construction defined in claim 20 in which the contact members are formed with ramp means; in which the control strips have ramp means at either end thereof; and in which said control strip ramp means guides the contact member ramp means smoothly onto the spaced metal strip conductors.

22. In controlled self-propelled car transportation apparatus of the type in which a car travels along a track system provided with channel track sections formed with spaced track rail heads having circularly rounded surfaces facing each other in spaced relation; the car including a chassis; a pair of spaced swivel axle means mounted on the chassis; guide rollers having grooves journaled on each end of each swivel axle means; the guide roller grooves having spring-pressed engagement with rounded rail head surfaces mounting the car for travel on said track system; pinch roll friction drive roller means mounted on the chassis between the spaced swivel axle means; the drive roller means having pressure roll driving engagement with one of the rail heads; and obstruction detecting bumper mechanism mounted on at least one end of the car including switch means actuated by said bumper means upon contact of the bumper means with an obstruction.

23. In controlled self-propelled car transportation apparatus of the type in which a car travels along a track system provided with channel track sections formed with spaced track rail heads having circularly rounded surfaces facing each other in spaced relation; the car including a chassis; a pair of spaced swivel axle means mounted on the chassis; guide rollers having grooves journaled on each end of each swivel axle means; the guide roller grooves having spring-pressed engagement with rounded rail head surfaces mounting the car for travel on said track system; pinch roll friction drive roller means mounted on the chassis between the spaced swivel axle means; the drive roller means having pressure roll driving engagement with one of the rail heads; swivel means mounted on the chassis; and a container for material to be transported by the car mounted on the swivel means; said container swivel mount allowing the container to orient in a horizontal position regardless of the position of the car traveling along the track system.

24. The construction defined in claim 23 in which the container has a door; and in which the door and car are provided with interlock means preventing car movement unless the door is closed and latched.

25. The construction defined in claim 24 in which the interlock means includes a motor for driving the drive roller means; latch means for the door; normally open switch means adjacent the latch means; control circuitry connecting the motor and switch means; and means maintaining the switch means closed when the door is latched closed; whereby when the door is unlatched, the normally open switch means deenergizes the motor.

26. The construction defined in claim 25 in which the control circuitry includes releasable contactor means mounted on the container-mount swivel means.

27. The construction defined in claim 26 in which the swivel means includes swivel plate means journaled on the car, and means releasably suspending the container from the swivel plate means; and in which the releasable contactor means includes spring pressed circuitry contact buttons carried by the swivel plate means, circuitry conductors extending through the container walls from the switch means to an area adjacent said contact buttons, and said conductors terminating in container-mounted contact wafers at said area in contact with said contact buttons when the container is suspended is suspended from said swivel plate means.

* * * * *

UNITED STATES PATENT AND TRADEMARK OFFICE

CERTIFICATE OF CORRECTION

PATENT NO. : 4,015,537

DATED : April 5, 1977

INVENTOR(S) : Harry T. Graef, Kenneth R. Hansen and Larry A. Morrison

It is certified that error appears in the above-identified patent and that said Letters Patent are hereby corrected as shown below:

Column 1, line 44 -- the word "rack" should be - track -.
Column 6, line 63 -- the word "ram" should be - ramp -.
Column 7, line 34 -- the word "FIGS." should be - FIG. -.
Col. 15, line 11, claim 11 - the word "strips" should be - strip -.
Col. 18, line 37, claim 27 - the words "is suspended" should be deleted.

Signed and Sealed this

Seventh Day of June 1977

[SEAL]

*Attest:*

RUTH C. MASON
*Attesting Officer*

C. MARSHALL DANN
*Commissioner of Patents and Trademarks*